United States Patent [19]

Sakaguchi

[11] Patent Number: 5,006,675

[45] Date of Patent: Apr. 9, 1991

[54] JACK WITH A SWITCH

[75] Inventor: Nobuya Sakaguchi, Nara, Japan

[73] Assignee: Hosiden Electronics Co., Ltd., Osaka, Japan

[21] Appl. No.: 501,756

[22] Filed: Mar. 30, 1990

[30] Foreign Application Priority Data

Apr. 3, 1989 [JP] Japan ..... 1-39733[U]

[51] Int. Cl.[5] ..... H01H 27/00

[52] U.S. Cl. ..... 200/51.09; 200/51.1; 200/51.11; 200/51.12

[58] Field of Search ..... 200/51.09, 51.10, 51.11, 200/51.12; 350/96.2; 439/188, 344, 676

[56] References Cited

U.S. PATENT DOCUMENTS

| | | | |
|---|---|---|---|
| 3,812,310 | 5/1974 | Gasparaitis et al. | 200/51.1 |
| 4,389,551 | 6/1983 | Deibele et al. | 200/51.09 |
| 4,666,231 | 5/1987 | Sheesley et al. | 439/188 |
| 4,698,025 | 10/1987 | Silbernagel et al. | 439/676 |
| 4,725,241 | 2/1988 | Bertini et al. | 200/51.1 |

FOREIGN PATENT DOCUMENTS

| | | | |
|---|---|---|---|
| 2112589 | 7/1983 | United Kingdom | 439/188 |

*Primary Examiner*—Henry J. Recla
*Assistant Examiner*—Glenn T. Barrett
*Attorney, Agent, or Firm*—Pollock, Vande Sande and Priddy

[57] ABSTRACT

A jack with a switch, the body of which is formed of an insulating material and has formed therein a plug receiving hole and a switch housing portion extending from the back of the body in parallel to but separated by a partition wall from the plug receiving hole. The partition wall has a hole through which the plug receiving hole and the switching housing portion communicate with each other. In the switch housing portion there are disposed a fixed contact piece and an elastic movable contact piece which constitute the switch. A separator is interposed between the movable contact piece and the partition wall, and an actuating projection formed at the tip end portion of the separator protrudes into the plug receiving hole through the hole made in the partition wall. By inserting a plug into or pulling it out of the plug receiving hole, the actuating projection is driven to effect ON/OFF control of the fixed and movable contact pieces of the switch.

4 Claims, 5 Drawing Sheets

JACK WITH A SWITCH

BACKGROUND OF THE INVENTION

The present invention relates to a jack with a switch of the type in which when a plug is inserted into a plug receiving hole made in a body of an insulating material, a plurality of contact pieces make contact with the plug and, at the same time, the ON/OFF state of a switch composed of movable and fixed contact pieces is controlled.

In a conventional jack with a switch, there is a risk that if a plug inserted thereinto is wrenched or twisted, the movable contact piece of the switch will be deformed permanently, resulting in bad contact of the switch.

SUMMARY OF THE INVENTION

It is therefore an object of the present invention to provide a jack with a switch which is free from the possibility of bad contact of the switch, even if the plug is wrenched or twisted.

According to the present invention, the body of the jack has a switch housing portion extending from its back in adjacent and substantially parallel relation to a plug receiving hole separated by a partition wall from the switch housing portion, and the partition wall has a hole through which the switch housing portion and the plug receiving hole intercommunicate. A separator of an insulating material is disposed in the switch housing portion along the partition wall. An actuating projection fomred at the forward end portion of the separator protrudes into the plug receiving hole through the communicating hole. A fixed contact piece and a movable contact piece are disposed in the switch housing portion and the movable contact piece is held in contact with the separator. When a plug is inserted into the plug receiving hole, the separator is displaced, thereby moving the movable contact piece out of contact with the fixed contact piece.

DESCRIPTION OF THE PREFERRED EMBODIMENT

Figure 1:
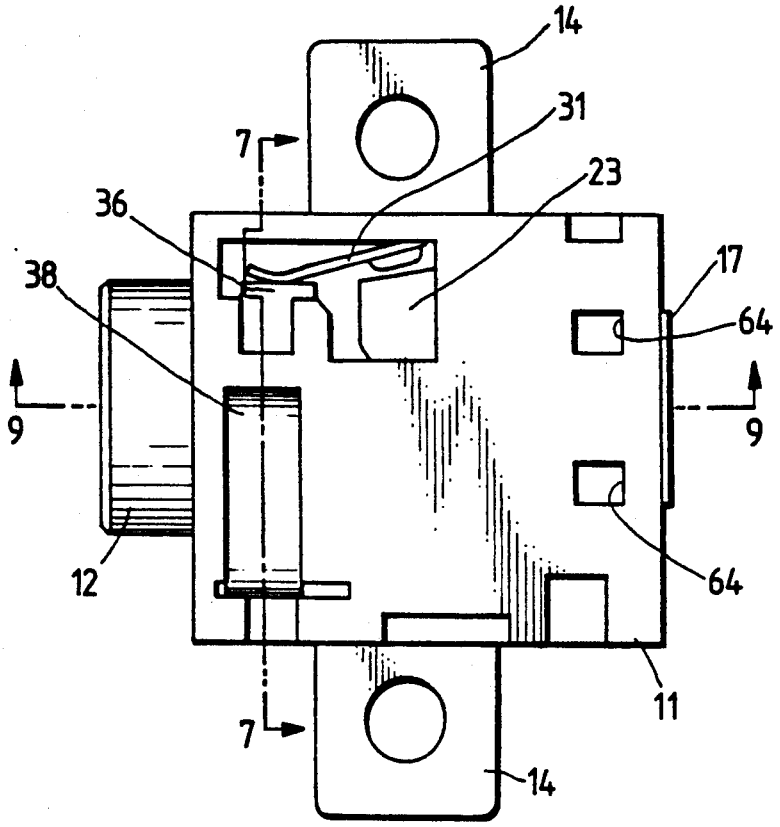
FIG. 1 is a plan view illustrating an embodiment of the jack according to the present invention.
Figure 2:
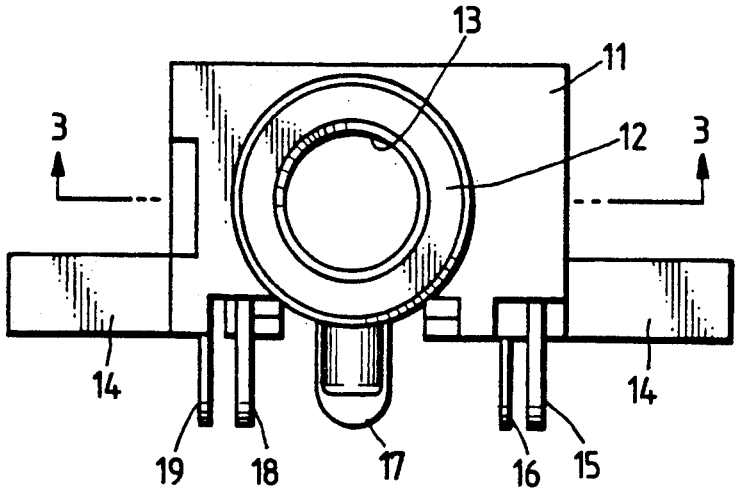
FIG. 2 is a left-hand side view of the jack shown in FIG. 1.

FIGS. 1 and 2 are a plan and a front view of the jack according to the present invention. A body 11 of an insulating material is substantially rectangular parallelpipedic in shape and has a sleeve 12 protrusivly provided on its front and a plug receiving hole 13 made in the body 11 in communication with the opening of the sleeve 12. Projecting out horizontally from either side of the body 11 is a mounting piece 14. A terminal 15 of a ground contact piece, a terminal 16 of a tip contact piece, a terminal 17 of a ring contact piece and terminals 18 and 19 of fixed and movable contact pieces forming a switch project out downwardly from the bottom of the body 11.

Figure 3:
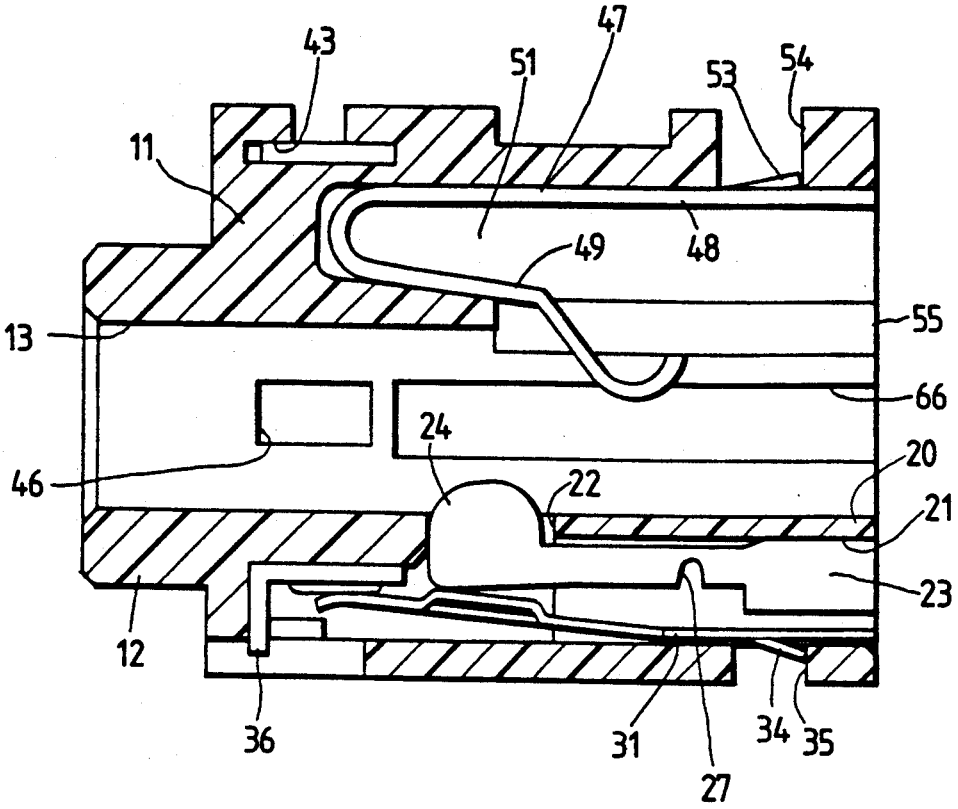
FIG. 3 is an enlarged sectional view taken on the line 3—3 in FIG. 2.
Figure 4:
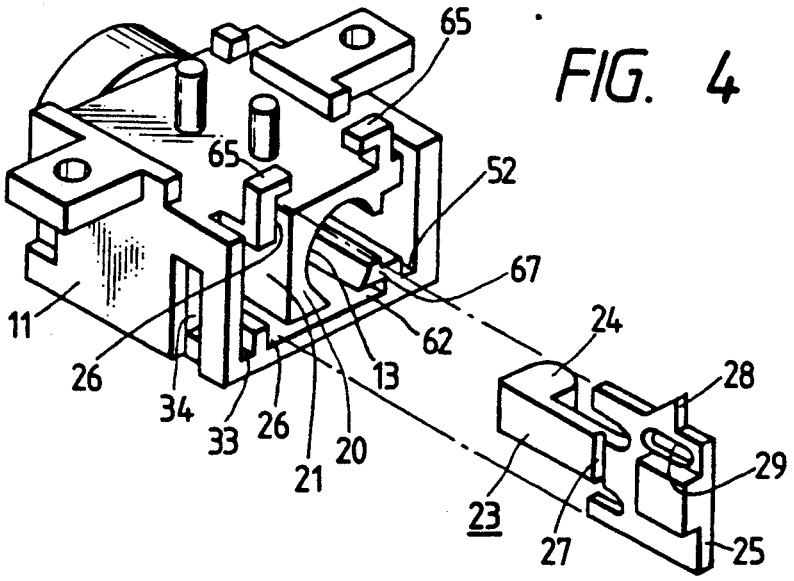
FIG. 4 is an exploded perspective view showing the relationship between the body of the jack and a separator.

FIG. 3 is a horizontal sectional view taken on the line 3—3 in FIG. 2. In one side wall of the body 11 there is provided a switch housing portion 21 which extends from the back of the body 11 in adjacent and parallel relation to the plug receiving hole 13 separated by a partition wall 20 from the switch housing portion 21. The partition wall 20 has a hole 22 through which the switch housing portion 21 and the plug receiving hole 13 communicate with each other. A separator 23 is disposed in the switch housing portion 21 along the partitiion wall 20. The separator 23 is made of an insulating material and has at its forward end an actuating projection 24 formed integrally therewith, and the actuating projection 24 projects out into the plug receiving hole 13 through the hole 22. As shown in FIG. 4, the rear end portion of the separator 23 forms a wide stationary portion 25, which is fixed in a guide groove 26 formed in the switch housing portion 21 along the partition wall 20. The separator 23 has as groove 27 extending widthwise thereof near the fixed portion 25 to form a hinge portion. The stationary portion 25 has a claw 28 formed on its marginal edge for engagement with a recess (not shown) made in the guide groove 26 so as to prevent the separator 23 from slipping out of the guide groove 26. The fixed portion 25 has an elongated hole 29 near the claw 28 so that the claw 28 may be elastically displaced when engaging the above-mentioned recess.

Figure 5:
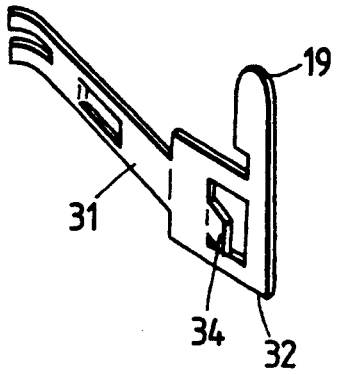
FIG. 5 is a perspective view showing a movable contact piece 31.

As shown in FIG. 3, a flexible movable contact 31 is received in the switching housing portion 21 opposite the outside of the separator 23. As shows in FIG. 5, the rear end portion of the movable contact piece 31 has a wide stationary portion 32, which has formed integrally therewith the aforementioned terminal 19. The stationary portion 32 is fixed in a guide groove 33 (FIG. 4) made in the switch housing portion 21, and a claw 34 is engaged with a recess 35 (FIG. 3) to prevent the movable contact piece 31 from slipping out of the guide groove 33. The movable contact 31 is bent at the base of the stationary portion 32 toward the separator 23 and makes elastic contact with the forward end portion of the separator 23.

Figure 6:
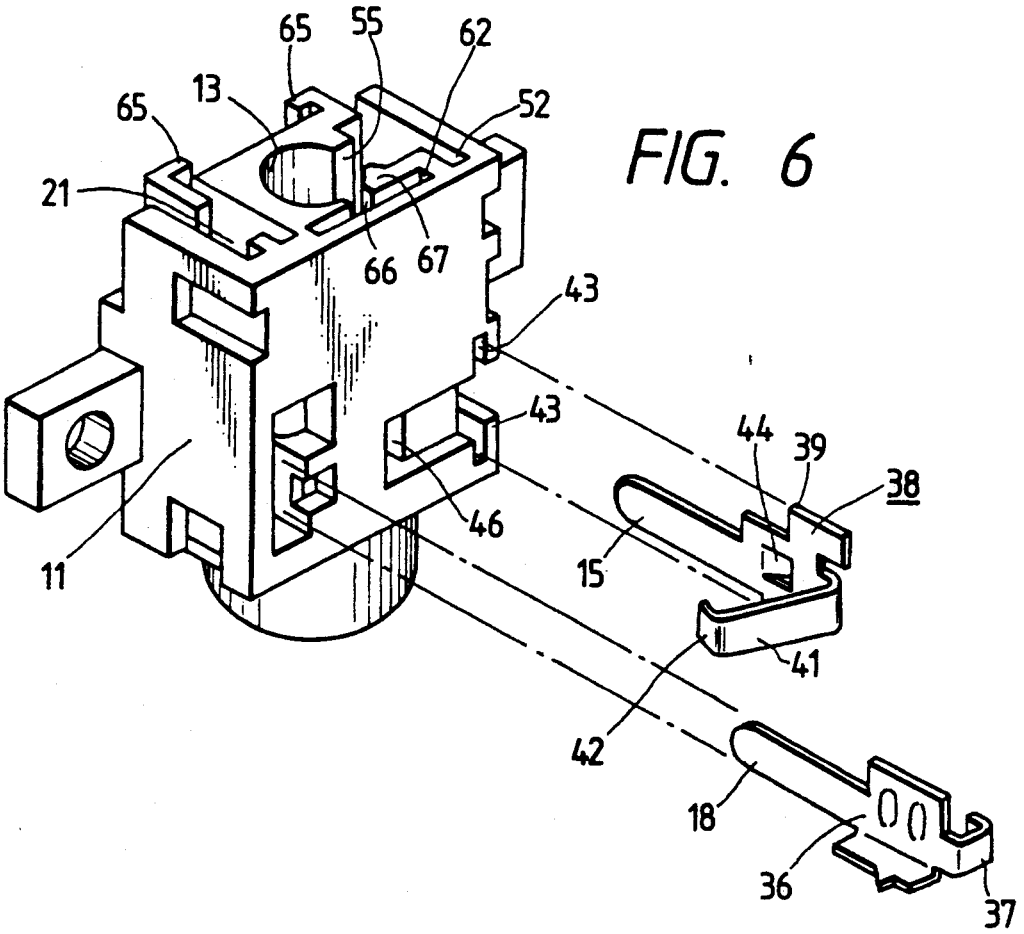
FIG. 6 is an exploded perspective view showing the relationship between the body of the jack and fixed and ground contact pieces 36 and 38.
Figure 7:
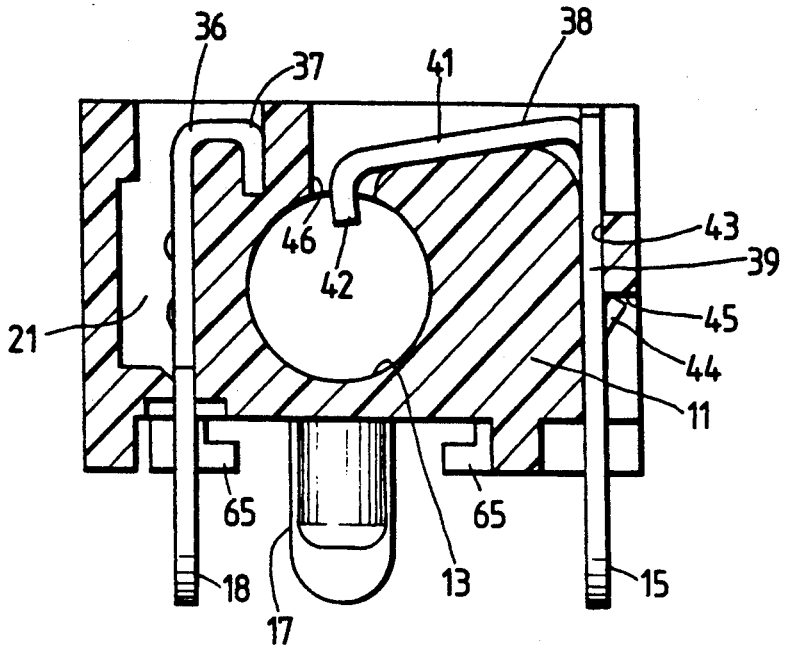
FIG. 7 is an enlarged sectional view taken on the line 7—7 in FIG. 1.

In the switch housing portion 21 a fixed contact piece 36 is disposed forwardly of the separator 23 as depicted in FIG. 3. The forward end portion of the movable contact piece 31 is in elastic contact with the fixed contact piece 36, holding the switch in the ON state. The fixed contact piece 36 has its top end portion bent to form an engaging portion 37 and has at its lower end the aforementioned terminal 18 as shown in FIGS. 6 and 7. The fixed contact piece 36 is received in a groove which extends from the top to the bottom of the body 11 across the switch housing portion 21.

A ground contact piece 38 is mounted on the front portion of the body 11 as depicted in FIG. 6. The ground contact piece 38 has a stationary portion 39, the aforementioned terminal 15 extending from its lower end an arm portion 41 extending from the upper end of the stationary portion 39 substantially at right angles thereto, and a contact portion 42 formed by bending back the tip end portion of the arm portion 41. The body 11 has a ground contact piece receiving groove 43 vertically extending along the side of the body 11 opposite from the switch housing portion. The stationary portion 39 of the ground contact piece 38 is received and fixed in the groove 43, with a claw 44 of the stationary portion 39 engaged with a recess 45 to prevent the contact piece 38 from coming off, as shown in FIG. 7. The top surface of the body 11 has made therein a small window 46 which communicates with the plug receiving hole 13 and through which the contact portion 42 of the ground contact piece 38 projects into the plug receiving hole 13.

Figure 8:
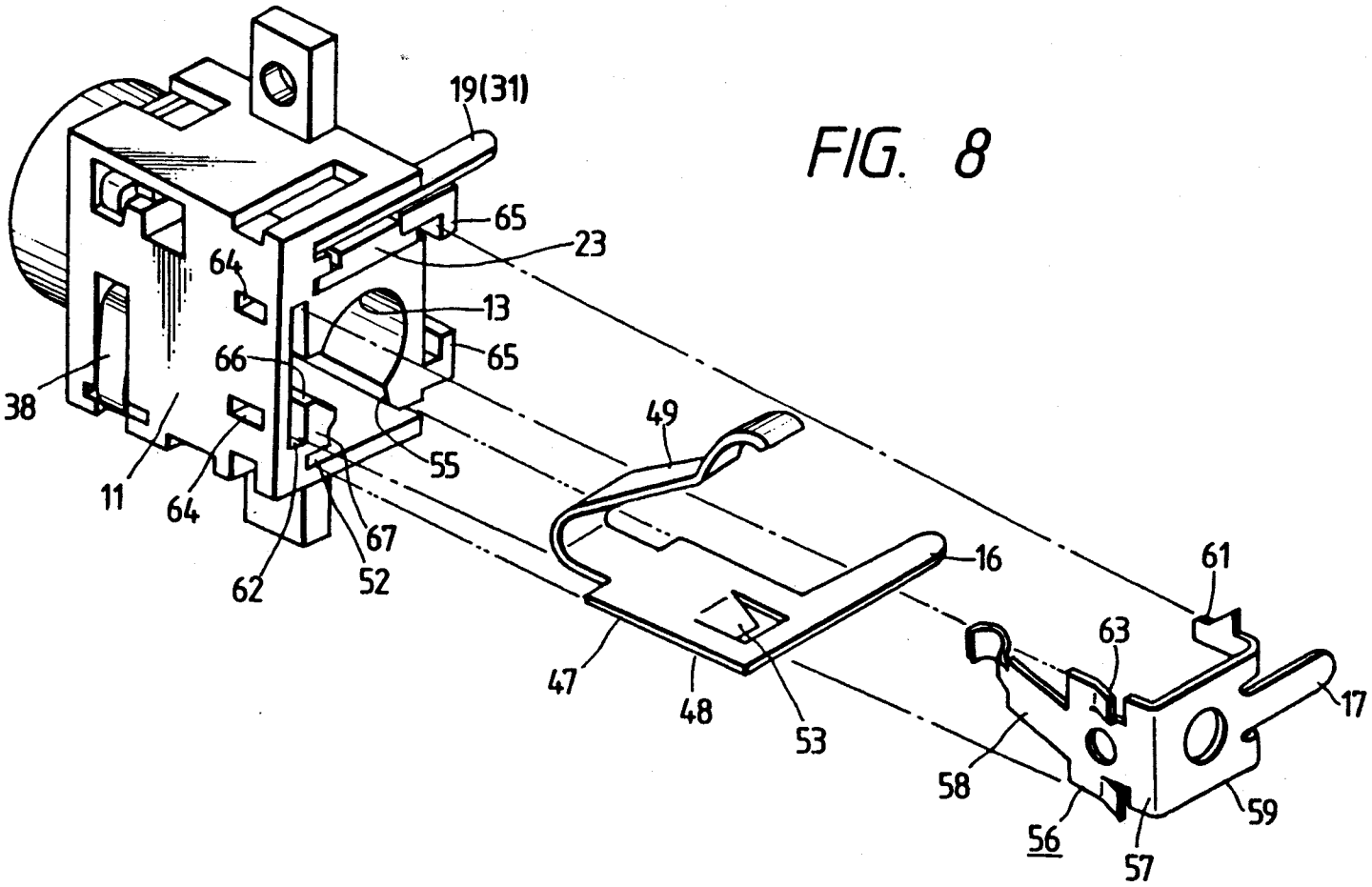
FIG. 8 is an exploded perspective view showing the relationship between the body of the jack and tip and ring contact pieces 47 and 56.

In the body 11 there is disposed a tip contact piece 47 on the side opposite from the switch housing portion 21 as shown in FIG. 3 for contact with a tip conductor of a plug (not shown) when the latter is inserted. The tip contact piece 47 is V-shaped as a whole and has a stationary portion 48, a contact piece 49 formed by turning up the forward end portion of the stationary portion 48, and the aforementioned terminal 16 extending from the stationary portion 48 as depicted in FIGS. 3 and 8. The body 11 has a tip contact piece housing portion 51 which extends from the back of the body 11 along the side opposite from the switch housing portion 21. The tip contact piece 47 is received in the housing portion 47 is fixed in a guide groove 52 formed in the tip contact piece housing portion 51, with a claw 53 of the stationary portion 48 engaged with a recess 54 to prevent the tip contact piece 47 from coming off. A groove 55, which has a width smaller than $\sqrt{2}$ times the radius of the plug receiving hole 13 and through which the plug receiving hole 13 and the tip contact piece housing portion 51 intercommunicate, is formed extending from the back of the body 11, and the rear end portion of the contact piece 49 of the tip contact piece 47 extends into the plug receiving hole 13.

Figure 9:
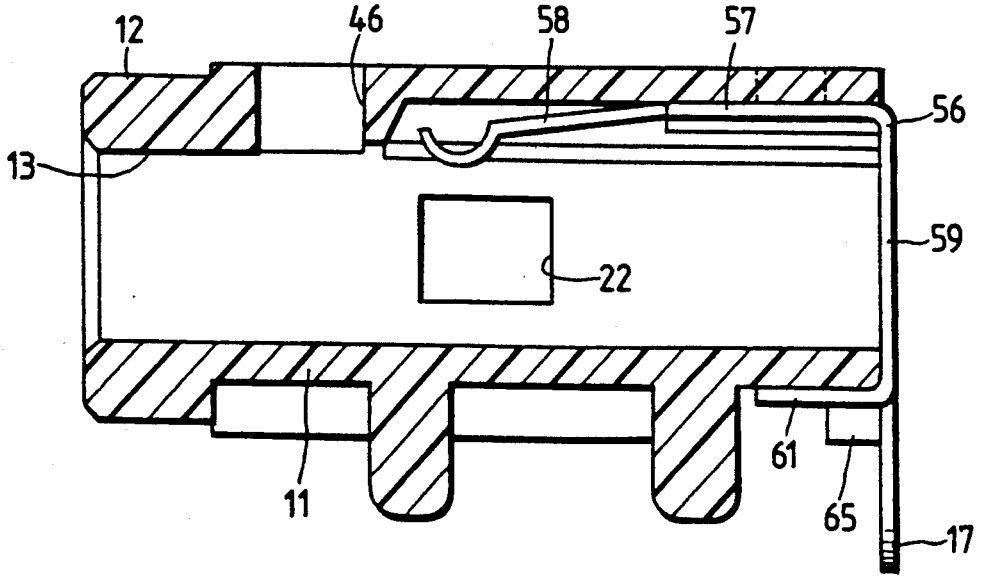
FIG. 9 is an enlarged sectional view taken on the line 9—9 in FIG. 1.

In the body 11 there is also housed in a ring contact piece 56 as shown in FIG. 9 for contact with a ring conductor of the plug (not shown). The ring contact piece 56 has a stationary portion 57, a contact piece 58 extending forwardly therefrom, a back portion 59 extending from the stationary portion 57 at right angles thereto, the aforementioned terminal 17 extending downwardly from the lower end of the back portion 59, and a locking piece 61 extending forwardly from the lower end of the back portion 59 as depicted in FIGS. 8 and 9. Along the top of the body 11 there is formed a ring contact piece receiving groove 62 extending from the back of the body 11. The stationary portion 57 and the contact piece 58 of the ring contact piece 56 are fixed in the groove 62, with a claw 63 of the stationary portion 57 engaged with a hole 64 in the top of the body 11 to prevent the ring contact piece 56 from coming off. The back portion 59 of the ring contact piece 56 is held in contact with the back of the body 11 and the locking piece 61 is locked with a locking portion provided on the underside of the bottom of the body 11. The plug receiving hole 13 and the ring contact piece housing groove 62 intercommunicate through a groove 66 which extends from the back of the body 11 and has a width smaller than $\sqrt{2}$ times the radius of the plug receiving hole 13. The forward end portion of the contact piece 58 of the ring contact piece 56 extends into the plug receiving hole 13 through the groove 66. Between the grooves 55 and 66 a rib 67, which has a surface coextensive with the inner peripheral surface of the plug receiving hole 13, extends axially thereof to the back of the body 11.

With the structure described above, when a plug (not shown) is inserted into the plug receiving hole 13, a ground conductor, a tip conductor and a ring conductor of the plug make elastic contact with the contact portion 42 of the ground contact piece 38, the contact piece 49 of the tip contact piece 47 and the contact piece 58 of the ring contact piece 56, respectively. At the same time, the actuating projection 24 of the separator 23 is pressed back into the switch housing portion 21, that is, the forward end portion of the separator 23 is displaced, by which the movable contact piece 31 is moved out of contact with the fixed contact piece 36, turning OFF the switch.

As described above, according to the present invention, since the actuating projection 24 of the separator 23 protrudes into the plug receiving hole 13 through the small hole 22, the plug, even if wrenched or twisted toward the switch housing portion 21, will bump against the wall of the plug receiving hole 13; so that the movable contact piece 31 is protected from twisting of the plug. Even if the plug is twisted when its tip stays at the position of the hole 22, the movable contact piece 31 will only be elastically displaced by the actuating projection 24 of the separator 23 toward the outer wall surface of the switch housing portion 21, and hence the movable contact piece 31 is protected from permanent deformation.

In the above embodiment, since the ground contact piece 38 is provided in the form of a cantilever spring with its contact portion protruding into the plug receiving hole 13 through the small window 46, the ground contact piece 38 is protected against twisting of the plug toward it. Moreover, twisting of the plug toward the tip contact piece 47 and the ring contact piece 56 is limited by the wall surface of the plug receiving hole 13 and the rib 67 which define the narrow grooves 55 and 66, and consequently the tip contact piece 47 and the ring contact piece 56 are protected.

It will be apparent that many modifications and variations may be effected without departing from the scope of the novel concepts of the present invention.

What is claimed is:

1. A jack comprising a body of insulating material having a plug receiving hole therein, said body supporting a plurality of contact pieces and a switch, said contact pieces and switch being so arranged that, when a plug is inserted into said plug receiving hole, said plurality of contact pieces make contact with said plug and said switch is actuated to an ON or OFF state;

said body having a switch housing portion extending from a back face of said body substantially parallel to a central axis of said plug receiving hole, said plug receiving hole being separated by a partition wall from said switch housing portion;

said partition wall having a communicating hole therein through which said switch housing portion and said plug receiving hole communicate with each other;

a separator of insulating material disposed in said switch housing portion along said partition wall;

an actuating projection formed at a forward end portion of sais separator, said actuating projection protruding into said plug receiving hole through said communicating hole;

said switch comprising fixed and movable pieces disposed in said switch housing portion, said movable piece being engaged by said separator, insertion of said plug into said plug receiving hole being operative to engage said actuating projection of said separator to displace said movable piece into or out of contact with said fixed piece;

a first outer wall surface of said body parallel to said central axis of said plug receiving hole having a window communicating with said plug receiving hole;

said body having a first groove extending from said first outer wall surface, along a second outer wall surface of said body perpendicular to said first outer wall surface but parallel to said central axis of said plug receiving hole, to a third outer wall surface of said body parallel to said first outer wall surface; and a first one of said plurality of contact pieces being disposed in said first groove, said first contact piece having a stationary portion fixed in said first groove, a ground terminal extending from said stationary portion and projecting out of said first groove, and an elastic contact portion extending from said stationary portion substantially at right angles thereto and along said first outer wall surface of said body, said elastic contact portion having a tip end portion that projects into said plug receiving hole through said window.

2. The jack of claim 41 wherein said switch housing portion has a guide groove therein, said separator having a hinge portion of reduced thickness which extends widthwise thereof and a stationary portion which extends rearwardly from said hinge portion, said separator being received in said guide groove with said stationary portion fixed therein so that said separator is elastically movable about said hinge portion.

3. The jack of claim 1 or 2 wherein said body has a first side wall parallel to said central axis of said plug receiving hole, said first side wall having a contact piece receiving portion extending from said back face of said body substantially in parallel to said plug receiving hole; said body having a second groove extending from said back face of said body substantially in parallel to said plug receiving hole, said plug receiving hole and said contact piece receiving portion communicating with each other through said second groove; and a second one of said plurality of contact pieces being disposed in said contact piece receiving portion, said second contact piece having a stationary portion fixed in said contact piece receiving portion, a terminal which extends from a rear end of said stationary portion of said second contact piece and projects out of said body, and an elastic contact piece which extends rearwardly from a front end of said stationary portion of said second contact piece and projects into said plug receiving hole through said second groove.

4. The jack of claim 3 wherein said body has a second side wall which is parallel to said central axis of said plug receiving hole and substantially perpendicular to said first side wall, said second side wall having a contact piece receiving groove extending in the axial direction of said plug receiving hole froms said back face of said body; said body having a third groove extending in the axial direction of said plug receiving hole from said back face of said body; a rib coextensive with an inner peripheral surface of said plug receiving hole, said rib being disposed between said second and third grooves; and a third one of said plurality of contact pieces being disposed in said contact piece receiving groove said third contact piece having a stationary portion which is fixed in said contact piece receiving groove, an elastic contact portion which extends from a front end of said third contact piece and projects into said plug receiving hole through said third groove, a back portion which extends from a rear end of said stationary portion of said third contact piece at right angles thereto and is pressed against said back face of said body, and terminal portion which extends from an end portion of said back portion of said third contact piece.

* * * * *